US007458236B2

(12) United States Patent
Kinder et al.

(10) Patent No.: US 7,458,236 B2
(45) Date of Patent: Dec. 2, 2008

(54) DEVICE FOR FEEDING FIBER BANDS TO A KNITTING MACHINE

(75) Inventors: Karl-Heinz Kinder, Burkhardtsdorf (DE); Wolfgang Pester, Chemnitz (DE); Gottfried Roth, Chemnitz (DE); Dietmar Reuchsel, Chemnitz (DE); Frank Schubert, Chemnitz (DE); Frank Vettermann, Jahnsdorf (DE); Alexander Wegner, Chemnitz (DE); Astrid Kirchberg, Chemnitz (DE)

(73) Assignee: Karl Mayer Malimo Textilmaschinenfabrik GmbH, Chemnitz (DE)

( * ) Notice: Subject to any disclaimer, the term of this patent is extended or adjusted under 35 U.S.C. 154(b) by 231 days.

(21) Appl. No.: 11/360,406

(22) Filed: Feb. 24, 2006

(65) Prior Publication Data

US 2006/0225465 A1 Oct. 12, 2006

(30) Foreign Application Priority Data

Feb. 25, 2005 (DE) ..... 10 2005 008 705

(51) Int. Cl.
*D04B 15/42* (2006.01)

(52) U.S. Cl. ..... 66/125 R

(58) Field of Classification Search ..... 66/84 A, 66/125 R, 146, 84 R
See application file for complete search history.

(56) References Cited

U.S. PATENT DOCUMENTS

| | | | | |
|---|---|---|---|---|
| 3,732,708 A | | 5/1973 | Troy | |
| 3,834,189 A | | 9/1974 | Kamp et al. | |
| 4,487,039 A | * | 12/1984 | Mayer | 66/84 A |
| 4,797,172 A | * | 1/1989 | Hebert et al. | 156/425 |
| 5,022,952 A | * | 6/1991 | Vaniglia | 156/441 |
| 5,072,602 A | | 12/1991 | Uaumann | |
| 5,200,018 A | | 4/1993 | Gill et al. | |
| 6,230,775 B1 | | 5/2001 | Smith et al. | |
| 6,340,126 B1 | | 1/2002 | McAlpine et al. | |
| 6,559,610 B2 | | 7/2003 | Homma et al. | |
| 2002/0160146 A1 | | 10/2002 | Homma et al. | |

FOREIGN PATENT DOCUMENTS

| | | |
|---|---|---|
| CH | 537216 | 7/1973 |

(Continued)

OTHER PUBLICATIONS

English language Abstract of JP 1-59384.

(Continued)

*Primary Examiner*—Danny Worrell
(74) *Attorney, Agent, or Firm*—Greenblum & Bernstein, P.L.C.

(57) ABSTRACT

A device for feeding fiber bands to a knitting machine, wherein the device includes a creel having at least one bobbin with at least one fiber band. Further, at least one feed drive driving at least one feeder roll, such that the fiber band is guided by the at least one feeder roll. Further still, a band storage including a motor driven control drive arranged to change the length of a variable length storage path for the at least one fiber band, wherein the band storage is arranged between the creel and the at least one feeder roll. A control device actuates the motor driven control drive and the at least one feed drive in a manner coordinated with one another.

18 Claims, 4 Drawing Sheets

FOREIGN PATENT DOCUMENTS

| | | |
|---|---|---|
| DE | 1535238 | 1/1971 |
| DE | 2344906 | 11/1974 |
| DE | 2455154 | 5/1975 |
| DE | 3832695 | 7/1989 |
| DE | 3842870 | 5/1990 |
| DE | 4439907 | 5/1996 |
| DE | 19739411 | 3/1999 |
| DE | 10312534 | 7/1999 |
| DE | 10003184 | 8/2001 |
| JP | 45-30012 | 9/1970 |
| JP | 49-6240 | 1/1974 |
| JP | 54-11420 | 5/1979 |
| JP | 54-117298 | 9/1979 |
| JP | 61-11271 | 4/1986 |
| JP | 1-43417 | 12/1989 |
| JP | 1-59384 | 12/1989 |
| JP | 5-58524 | 3/1993 |
| JP | 8-310728 | 11/1996 |
| JP | 11-189369 | 7/1999 |
| JP | 2002-241051 | 8/2002 |
| JP | 2004-161424 | 6/2004 |

OTHER PUBLICATIONS

English language Abstract of JP 2004-161424.
English language Abstract of JP 5-58524.
English language Abstract of JP 1-43417.
English language Abstract of DE 19739411.
English language Abstract of EP 8-310728.
English Language Abstract of JP11189369.

* cited by examiner

DEVICE FOR FEEDING FIBER BANDS TO A KNITTING MACHINE

CROSS-REFERENCE TO RELATED APPLICATIONS

The present application claims priority under 35 U.S.C. §119 of German Patent Application No. 10 2005 008 705.1-26, filed on Feb. 25, 2005, the disclosure of which is expressly incorporated by reference herein in its entirety.

BACKGROUND OF THE INVENTION

1. Field of the Invention

The invention relates to a device for feeding fiber bands to a knitting machine with a creel, in which at least one bobbin is arranged so that a fiber band can be drawn off with feeder rolls featuring a feed drive. The fiber band is guided through feeder rollers with a band storage, which has a variable-length storage path for the fiber band.

2. Discussion of Background Information

DE 100 03 184 A1 shows feeder rolls arranged at the output of the creel. The band storage follows the feeder rolls, and the band storage has a moveably supported guide roll, which is drawn downwards under the effect of gravity and additionally under the effect of a spring in order to accept a band length when it is not needed.

The above device is used to feed fiber bands of a band feed device to a knitting machine with a weft insertion system.

In a knitting machine with a weft insertion system, fiber bands are fed to the knitting area via two transport chains arranged in the area of the longitudinal edges of the knitted article and fixed to one another with stitch threads. The combined fiber bands are termed "fiber band scrim," and extend between the transport chains, which are provided with a holding device for the fiber bands. A band layer is located above the transport chains, wherein the fiber bands supplied by the device are conveyed over the transport chains and inserted into the holding device of the transport chains. The band layer transports the fiber band and places it in the transport chains only when crossing in one direction, i.e., from the transport chain facing the transfer station to the opposite transport chain. The back stroke of the band layer is carried out without the fiber band, since a reversing of the band transport has proven to be very difficult. After the back stroke of the band layer has been completed, the severed end of the fiber band is held ready in the transfer station which is again grasped and brought over the transport chains in the same order. The band layer thus removes the fiber band from the device with breaks, more specifically, the fiber band is not processed by the band layer at a constant speed.

Laying is an important aspect to fiber bands, so as to have a constant width in the fiber bands lateral extension, in order to prevent gaps between the individual inserted fiber bands. On the other hand, the tension of the fiber bands must be kept constant in order to prevent differences in the scrim. The fiber bands to be processed are mostly carbon fibers or glass fibers, which have a very low elasticity. Once differences in tension exist, it is virtually impossible to even them out again afterwards.

SUMMARY OF THE INVENTION

The present invention provides fiber bands that are laid as uniformly as possible.

According to the invention, the band storage can be arranged between the creel and the feeder rolls. The band storage can have a motor-driven control drive with which the length of the storage path is changed. A control device is provided which actuates the control drive and the feed drive in a manner coordinated with one another.

The device is able to reduce differences in tension in the fiber bands to a minimum, for example, differences in tension that are caused by the reeling-off process from the bobbin. The device can reel off the fiber band at a constant speed from the bobbin, which is usually braked, even if the fiber band is removed at the output of the device, only intermittently. The feeder rolls ensure the fiber band is fed positively to the band layer device. The delivery speed of the feeder rolls thereby coincides with the movement speed of the band layer device. As long as the band layer device is working, the fiber band is consumed. If, however, the band layer device is not laying any fiber band, e.g., because it is on the "return path," the feeder rolls do not further supply any fiber band. The band storage is used so the fiber band can still be drawn off the bobbin at a constant speed. However, the band storage does not simply passively accept a certain length of the fiber band via the control drive and the band storage and the feeder rolls, but consequently, the band storage is able to draw off the fiber band from the bobbin, since the band storage with the aid of the control drive extends the storage path. When the feeder rolls starts up again in order to feed the fiber band to the band layer device, the control drive is likewise actuated in order to shorten the storage path and thus releases a sufficient amount of fiber band. Through a corresponding coordination of control drive and feed drive, the instant invention makes it possible to draw off the fiber band from the bobbin at uniform speed over the entire production process, regardless of whether the band layer device is consuming fiber band or not. Since the fiber band can be drawn off at a constant speed, no differences in tension occur due to changes in speed, so that the fiber bands can be laid with a high degree of uniformity.

The band storage preferably features a guide roll supported on a carrier, whereby the carrier can be displaced by the control drive. According to one aspect of the instant invention, the control drive can move the carrier along a straight-line movement path. The storage path is thereby extended or shortened at doubled speed. Since the guide roll is not simply suspended on a spring, the danger of a vibration tendency is considerably reduced.

A band swivel device may be assigned to each bobbin, wherein the band swivel device can include a lever that swivels about an axis. An inflow guide adjacent to the bobbin and an outflow guide immediately adjacent to the axis can guide the fiber band from the output guide to a fixed starting point. In particular, the fiber band is wound on the bobbin in a cross winding. Thus, during the drawing off from the bobbin, the position at which the fiber band leaves the bobbin is a shifting to and fro over the entire axial length of the bobbin. According to a feature of invention, the band swivel device even with changing lifting positions, ensures the fiber band is always fed to a fixed starting point. The fiber band can then be guided further from the fixed starting point in a straight line. It is ensured through the inflow guide that the fiber band cannot break out of a provided guide path. The inflow guide and the outflow guide can be embodied simply as rectangular eyelets through which the fiber band is guided with its width. Further, after the fiber band has been drawn off the bobbin, the fiber band has not yet achieved its full width in which all the fibers lie next to one another. Instead, the fiber band is thicker than the thickness of one fiber.

A pressure device can be assigned to each bobbin, and extend over the length of the bobbin, wherein the fiber band is drawn off from the bobbin through a nip or roller gap between the pressure device and the bobbin. The pressure device can be loaded in the direction of the bobbin, e.g., by weight or spring force, so as to ensure that the fiber band cannot tilt or in any other way break out of the cross winding while being drawn off from the bobbin.

A bobbin heating device can be assigned to each bobbin. The bobbin heating device ensures that the fiber band is heated at least in one area on the surface of the bobbin. The heating of the fiber band is a measure that facilitates the spreading of the fiber band. Accordingly, a first spreading step may already occur at the pressure device.

A band heating arrangement can be arranged between the creel and the band storage. In this position, the band heating arrangement has the advantage that it heats a continuously running fiber band. Accordingly, even with simply constructed and controlled heating devices, the risk is slight that the fiber band will be overheated because, e.g., it is heated for too long at one place.

According to a feature of the invention, the band heating arrangement may have at least one heated guide rod arranged between the bobbin and the band swivel device. This guide rod can have two functions. First, it can be used to supply further heat to the fiber band, since the fiber band is guided around the guide rod. Secondly, it can be used so the fibers of the fiber band can position themselves freely in their alignment. Subsequently, the fiber band with the different tension ratios of the individual fibers resulting from the fact of the cross winding, is guided in a controlled manner to the fixed starting point, by using the band swivel device.

According to a feature of the invention, the band heating arrangement may have a band heating device at the intake of the band storage. The band heating device at the intake of the band storage can have one or more heated guide rods. The heating is used for the further spreading of the fibers in the fiber band. Expediently, the angle of wrap is adjustable by at least one guide rod. Thus, the spreading effect can be influenced. The band heating device at the intake of the band storage is the last position in which the fiber band is heated during a continuous movement.

A heating passage can be arranged in the movement direction of the fiber band behind the feeder rolls. The heating passage is able to act on the fiber band over a longer path and to provide the fiber band with a higher temperature and allow the feeder rolls to be supplied intermittently. In the heating passage, the fiber band can be heated during a stoppage.

According to a feature of the invention, the heating passage can have a length that corresponds to a movement stroke of a band layer downstream of the device. The entire fiber band, which is machined in the following working stroke of the band layer, is then brought to a uniform temperature in the heating passage. The fiber band then has no temperature differences in the longitudinal direction or the transverse direction. Differences in tension can thus also be kept small.

A heating device can be arranged at the output and, if necessary, a heating device at the intake of the heating passage. The heating device at the output of the heating passage can ensure a heating of the fiber band so that the fiber band can be finally spread out in a final spreading before it is fed to the band layer. The heating device at the intake can be advantageous so as to be able to introduce an already heated fiber band into the heating passage. In this case, the heat supply in the heating passage can take place more moderately.

According to a feature of the invention, at least one spreader element is arranged in the course of the fiber band, such that the spreader element has two guide edges running crosswise to the fiber band and arranged on opposite sides of the spreader element. The fiber element runs through the spreader element in an approximate S-shaped manner. Because it is deflected twice by approximately the same angle, the entire length of the fiber band does not change over its thickness. However, at each deflection, the outer fibers are acted on with an increased tension and try to push through inwards. This is possible because the inner fibers, i.e., those adjacent to the guide edge, are looser. After two guide edges have been passed through, an adequate spreading of the fiber band can be observed. According to a feature of the invention, it is possible the guide edges can also be formed by tubes. Further, projections may be provided on the first tube in the traveling direction of the fiber band or the first guide edge, such that the spacing of the projections correspond to the width of the fiber band. These projections are expediently rounded crosswise to the longitudinal extension of the fiber band. The fiber band is then guided between the respectively two projections. Although, this could cause the fiber band to be pushed together again slightly wherein a small gap occurs, i.e., on the order of millimeters, between adjacent fiber bands. However, this gap is closed again automatically at the next guide edge.

The guide edges may have a spacing from one another in the movement direction of the fiber band, wherein the spacing corresponds to 0.8 to 2 times the thickness of the spreader element. Thus, the guide edges can have a relatively small spacing. It may also be advantageous if the guide edges have a relatively small radius, i.e., a radius corresponding to half the thickness of the spreader element. The spreader element can also be embodied so that it is symmetrical to a middle plane. In this case, when the guide edges are worn out, a doubling of its serviceability can be achieved by simply turning over the spreader element.

The guide edges can delimit a slotted hole arranged crosswise to the fiber band. The slotted hole then defines the final width of the fiber band, which results in a spreader element that can be easily produced.

According to a feature of the invention, several spreader elements can be arranged such that their slotted holes connect to one another crosswise to the fiber band. A fiber arrangement then results behind the spreader elements, wherein the width of the fiber arrangement is a multiple of the width of a single fiber band. The individual fibers then lie relatively uniformly spaced next to one another according to a feature of the invention, it is possible to arrange at least two rows of slotted holes one behind the other in the longitudinal extension of the fiber band and to allow the slotted holes to overlap in different rows.

The spreader element can be arranged behind the heating passage. forming the completion of the spreading or the "final spreading."

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
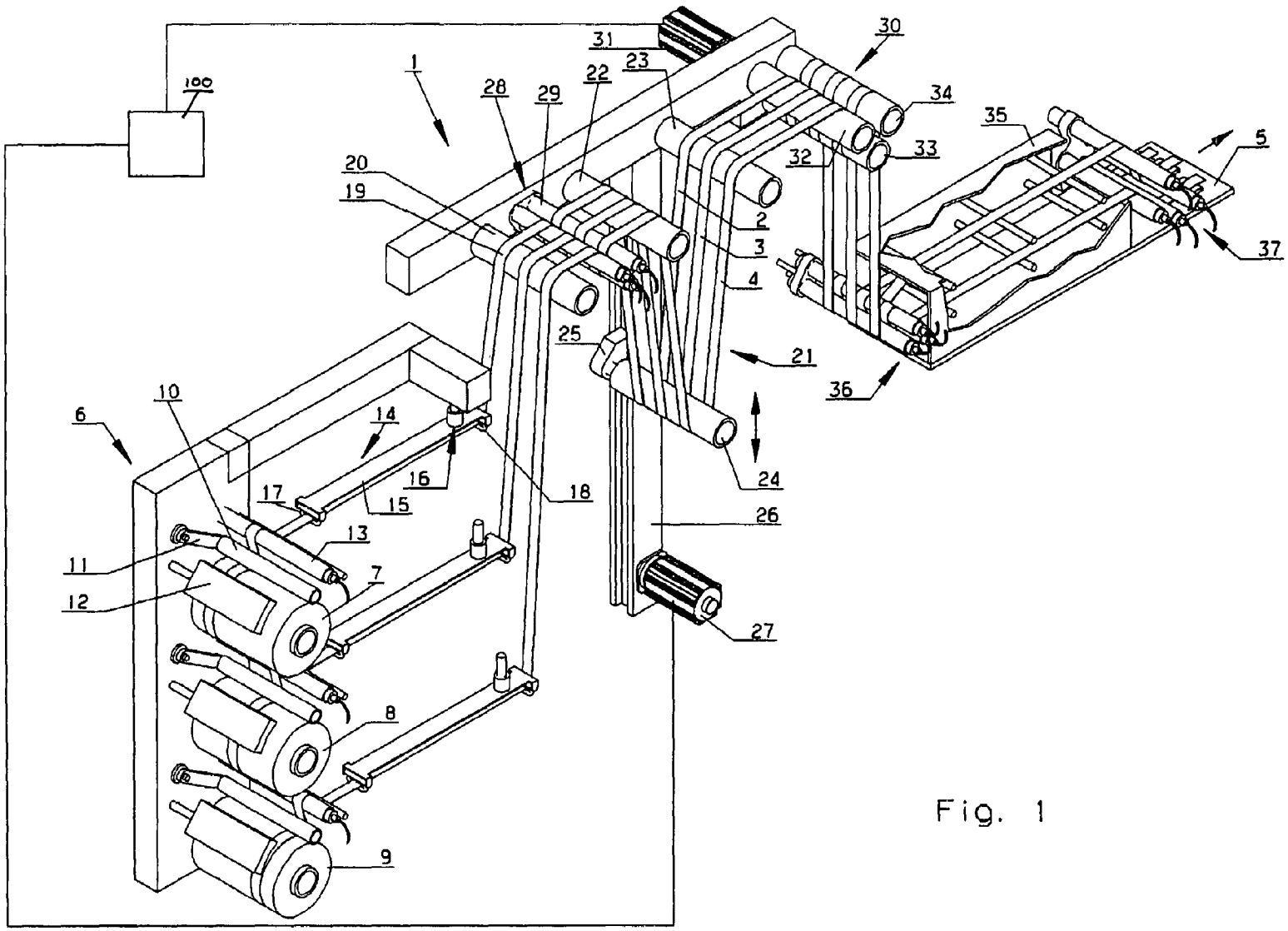
FIG. 1 A diagrammatic view of a device in perspective representation.
Figure 2:
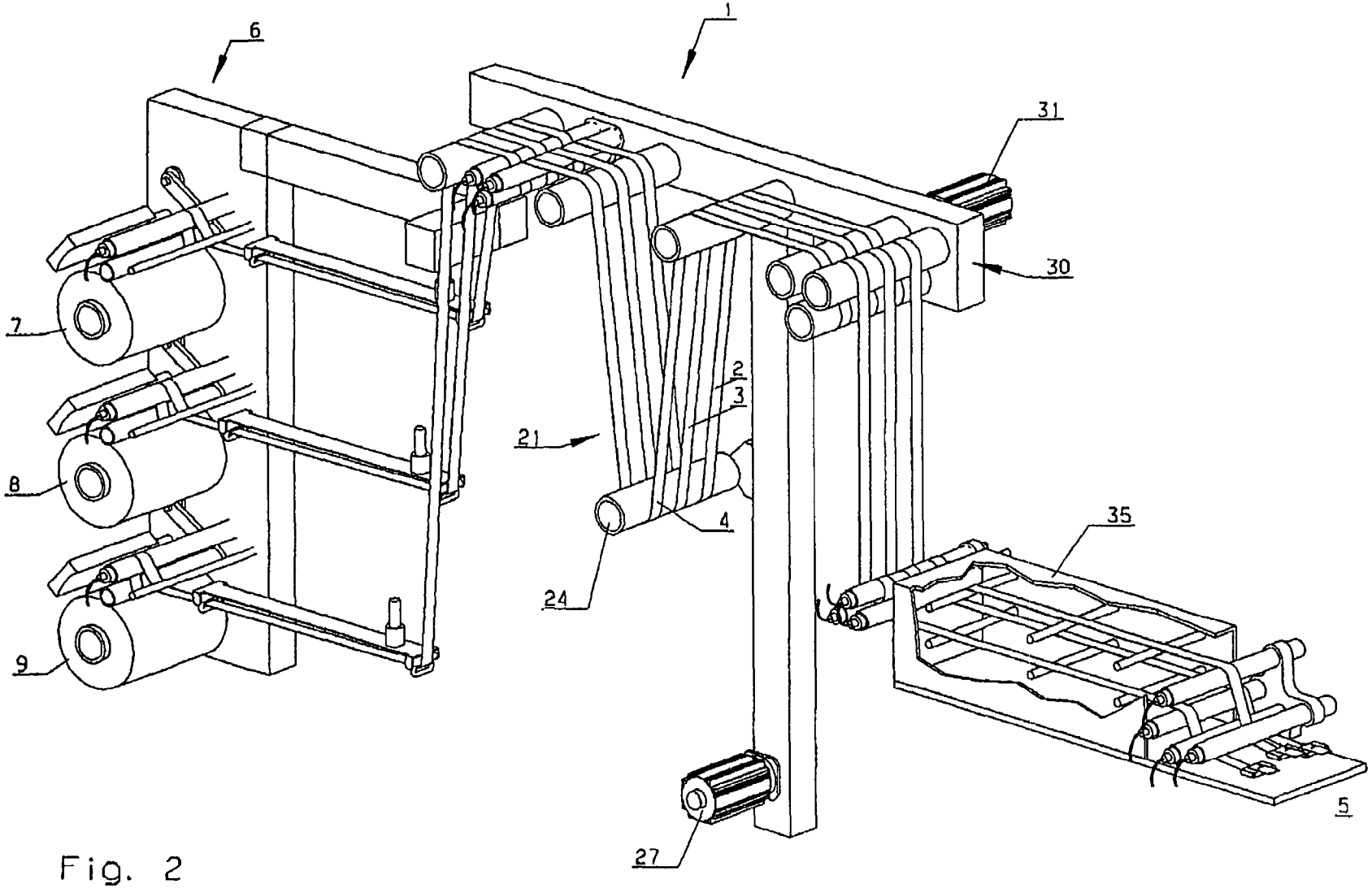
FIG. 2 A diagrammatic view of the device from another angle.

FIG. 1 shows a device 1 for feeding fiber bands 2-4 to a band layer device (not shown in further detail) of a knitting machine with a weft insertion system. The band layer device connects to an output 5 of the device 1.

The device 1 has a creel 6 in which a bobbin 7-9 is arranged for each fiber band 2-4. Each bobbin 7-9 is pivoted and braked, so that the fiber band 2-4 can be drawn off under a certain tension.

The structure is essentially the same for all the bobbins 7 through 9. The explanation is therefore based on the example of bobbin 7, but it is understood that bobbins 8, 9 are structurally the same as bobbin 7.

A pressure device 10 presses with a certain force on the circumference of the bobbin 7. The pressure device 10 has a roll rolling on the circumference of the bobbin 7, which the roll is suspended on a lever 11. The lever 11 is supported in the creel 6. The lever 11 is prestressed by a spring (not shown in further detail). Further, it is possible the lever 11 can be prestressed with a weight. It is also understood that a pressure device 10 can be provided for each bobbin 8, 9.

A bobbin heating device 12 can be associated with bobbin 7, such that the heating device 12 heats the fiber band on the surface of the bobbin 7 by either IR radiation or hot air.

The fiber band 2 drawn off from the bobbin 7 can be deflected around the pressure device 10 and then guided directly around a heated guide rod 13, so that the individual fibers, e.g., carbon fibers, which form the fiber band 2 can position themselves freely in their alignment.

The fiber band 2 can be wound on the bobbin 7 in a cross winding arrangement. The pressure device 10 prevents a premature constricting or tilting of the fiber band through the drawing off momentum. The fiber band 2, which constantly changes the angular position with respect to the bobbin 7 through the cross winding, cannot tilt or break out of the cross winding in any other way.

In order to further guide the fiber band 2 with the different tension ratios of the fibers which are caused by the cross winding, a band swivel device 14 is used that includes a lever 15 which can be pivoted around an axis 16. The axis 16 is arranged at the end of the lever 15 furthest removed from the bobbin 7.

At one end of the lever 15 can be an inflow guide 17 adjacent to the bobbin 7, and at the other end of the lever 15 can be an outflow guide 18 connecting virtually directly to the axis 16. Accordingly, in the outflow guide the fiber band 2 is virtually always in a constant position relative to the bobbin 7, regardless of the axial position from which the fiber band 2 is drawn off from the bobbin 7. Accordingly, the fiber band 2 can be guided at a fixed starting point 19 via a guide roll 20 that is arranged behind the bobbin creel 6.

According to the invention, the inflow guide 17 and the outflow guide 18 are respectively embodied as a curved tube or a guide edge curved in a different manner. The fiber band then converges in the deepest point of the curve and is guided relatively easily. The pushing together of the fibers can quite possibly lead to some fibers of the fiber band 2 lying one above the other, which is uncritical at this particular point, because the fiber band 2 can spread out again in the subsequent processing to an adequate extent.

A pressure device, a bobbin heating device and a guide rod are likewise provided for the other bobbins 8, 9. Only the axes 16 of the band swivel device, which are assigned to the other bobbins 8, 9 are displaced with respect to one another in the axial direction of the bobbins 7-9.

Figure 3A:
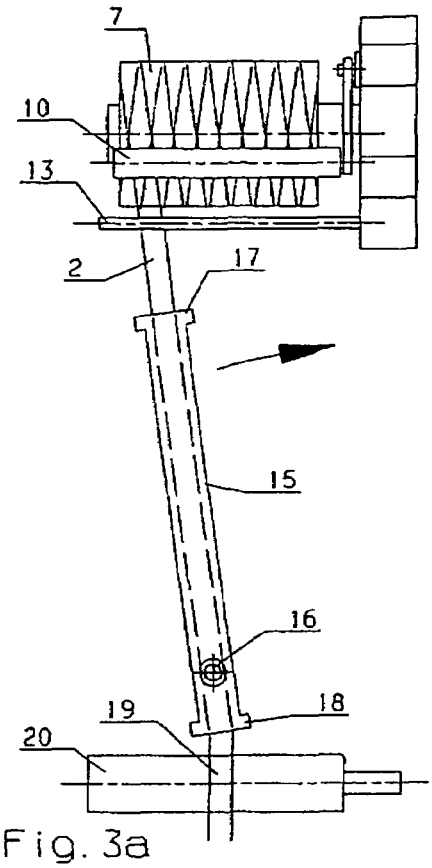
FIGS. 3*a* and 3*b* Diagrammatic views of a band swivel device.
Figure 3B:
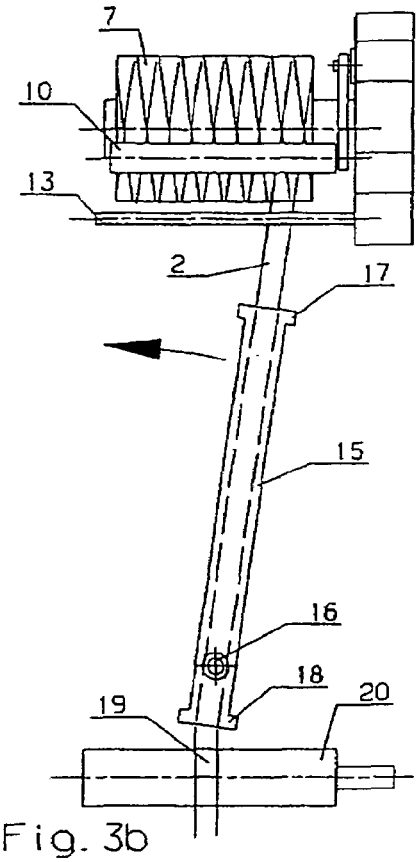
Figure 4:
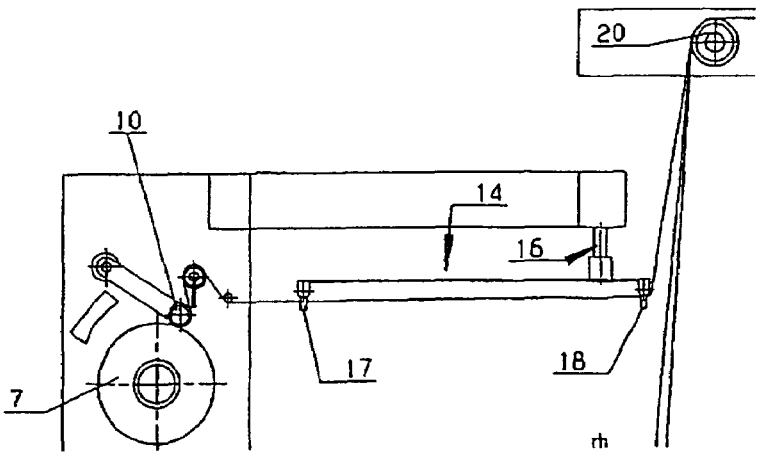
FIG. 4 A side view of the band swivel device.

The function of a band swivel device 14 can be viewed in FIGS. 3 and 4. The band 2 is lifted at different axial positions from the bobbin 7 due to the cross winding of the bobbin 7. The two extreme positions are shown in FIG. 3*a* and FIG. 3*b*. In FIG. 3*a*, the fiber band 2 is lifted from the left end of the bobbin 7 and in FIG. 3*b* from the right end of the bobbin 7. A tilting of the fiber band 2 is prevented through the pressure device 10. The fiber band 2 is guided as it were in an S-shaped manner through the heated guide rod 13. This guidance allows a first spreading of the fiber band.

When comparing FIGS. 3*a* and 3*b*, the fiber band 2 is guided on the guide roll 20 virtually always at the same point so that after it has left the band swivel device 14, a displacement of the fiber band 2 crosswise to its traveling direction is no longer given. The fiber bands receive a restricted guidance so that the fiber band 2 cannot tilt or break out of its provided guide band. The fiber band 2 can now be guided further in a straight line from the fixed starting point 19.

According to the invention, it may be advantageous to locate the guide roll 20 in the extension of the axis 16. Moreover, small placement is permissible between the guide roll 20 and the extension of axis 16, as shown in FIGS. 3*a* and 3*b*.

A band storage 21 can be arranged in the web traveling direction, or in the traveling direction of the fiber bands 2-4, behind the creel 6, such that the band storage may include a moveable guide roll 24 between two stationary guide rolls 22, 23. The moveable guide roll 24 can be arranged on a carriage 25 which can be moved to and fro in a guide 26. The movement is caused by a control device 27, e.g., an electric motor, which moves the carriage 25 upwards or downwards via a corresponding gear device. The control drive 27 is controlled by a control device 100, to which it is connected.

A heating device 28 can be arranged between the band storage 21 and the fixed starting point 19 on the guide roll 20. The heating device 28 may include three heated guide rods 29 (but not limited by number such that one or more may be used) which the fiber bands 2-4 can be guided. The guide rods 29 are preferably electrically heated. The angle of wrap can be adjusted in order to influence the spreading effect.

Feeder rolls 30 which have a feed drive 31 are arranged in the web traveling direction behind the band storage 21. The feeder rolls 30 have several rolls 32-34 around which the fiber bands 2-4 are guided. These rolls 32-34 are actuated in synchronism with one another by the feed drive 31, causing a feeding action of the fiber bands 2-4.

A heating passage 35 can be arranged in the traveling direction of the fiber bands 2-4 behind the feeder rolls 30, at the intake of the heating passage. A heating device 36 may include several heated guide rods positioned at an input of the heating passage 35. Further, a heating device 37 including one or more heated guide rods can also be arranged at the output of the heating passage 35. The heating passage 35 includes a length that corresponds to the laying stroke of a downstream band layer device (not shown). If the band layer device at a cycle or stroke, e.g., consumes fiber bands with a length of 2.5 m, then the heating passage 25 can have a length of at least 2.5 m. The feed drive 31 is connected to control device 100.

Figure 5:
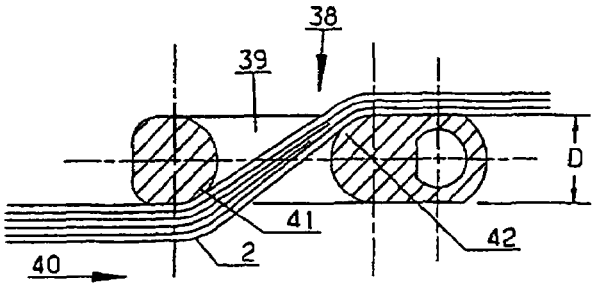
FIG. 5 A detailed view of a spreader element.
Figure 6:
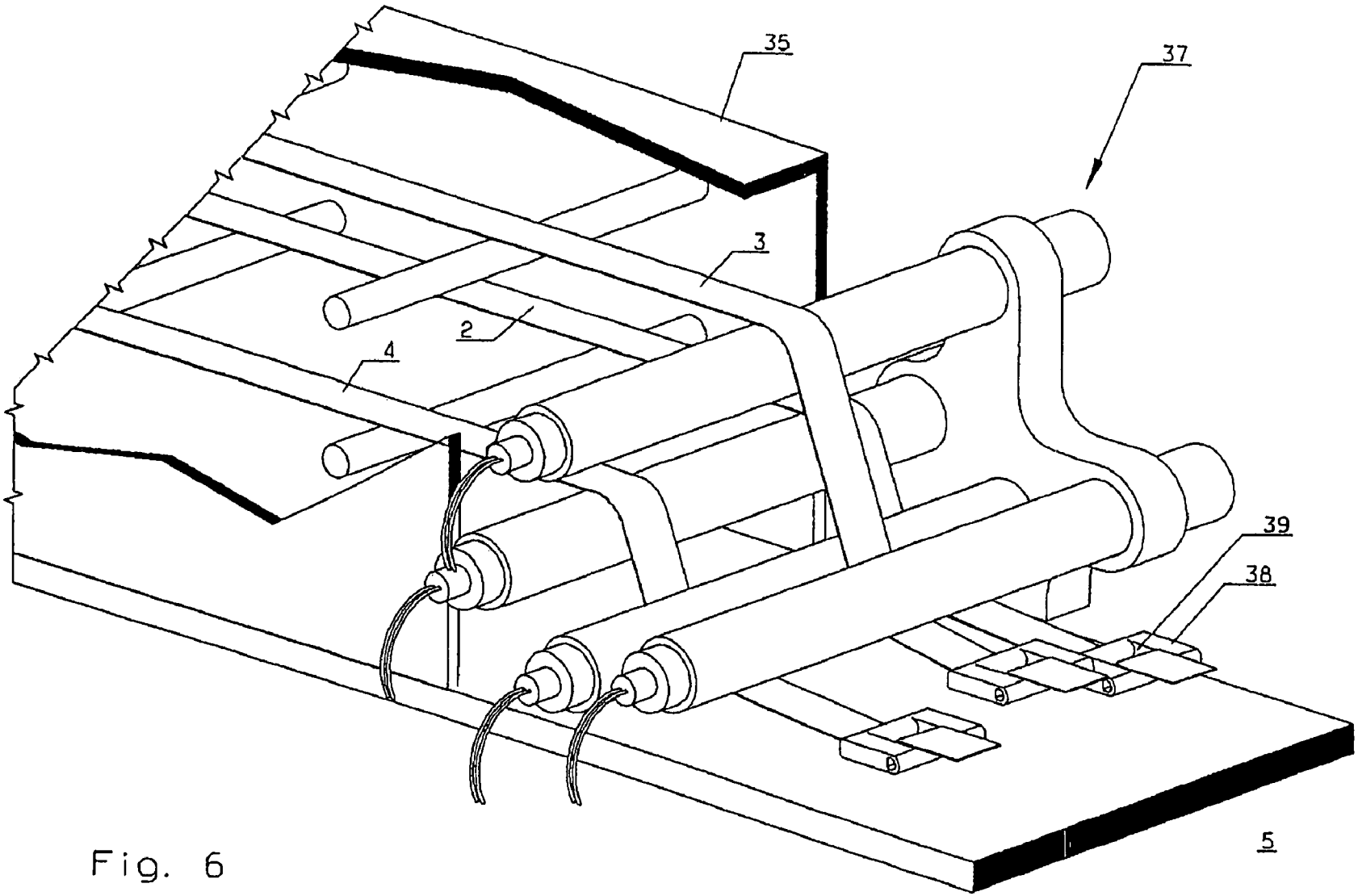
FIG. 6 A diagrammatic view of an output of a heating passage in perspective view.

A spreader element 38 (shown in cross section in FIG. 5) can be arranged for each fiber band 24 at the output 5 of the device, i.e., in the web traveling direction behind the heating device 37. The spreader element 38 has a slotted hole 39 that extends crosswise to the longitudinal extension of the fiber band 2. The slotted hole 39 is limited in the traveling direction 40 of the fiber band 2 in front by a first guide edge 41 and behind by a second guide edge 42. The two guide edges 41, 42 have a relatively small spacing from one another. This spacing is in the range of 0.8 to 2 times the thickness D of the spreader element 38. Its radius is D/half.

The fiber band 2 is guided around the guide edges 41, 42 once under and once over the spreader element 38. The fibers respectively lying inside the fiber band 2 are thereby looser than the outer fibers. The outer fibers are taut, i.e., they are under an increased tension, and try to push inwards. However, the same length ultimately results for all the fibers because the fiber band 2 is deflected twice, so that after leaving the spreader element 38 the fibers are arranged in good order next to one another. The width of the slotted hole 39, thus the extension crosswise to the direction of movement 40, then determines the maximum width of the spread fiber band 2.

The spreader elements 38 are positioned relative to one another such that their slotted holes 39 connect to one another so that the individual fiber bands 2-4 can connect directly next to one another. The slotted holes 39 can also be arranged in several rows, whereby the slotted holes 39 of different rows then can overlap, resulting in the fiber bands virtually having no gaps. However, even when the slotted holes 39 separated from one another by small breaks, it is uncritical, because the fiber bands can spread out again to an adequate extent after leaving the slotted holes 39.

The device 1 can operate with the fiber bands 2-4 drawn off the bobbins 7-9 at a constant speed and fed through the band swivel device 14 to predetermined positions. The constant speed of the fiber bands 2-4 is maintained right into the band storage 21.

However, the feeder rolls 30 intermittently supply fiber bands 2-4, i.e., only when the band layer device, which is arranged at the output 5 of the device, requires fiber bands. The feed drive 31 and the control drive 27 are therefore coordinated to the extent that when the feed drive 31 reduces the feeding action of the fiber bands 2-4, the control drive 27 takes over the function of drawing off fiber bands 2-4 from the bobbins 7-8. When the feed drive 31 pauses, the control drive 27 works practically at half the speed because the storage path is enlarged or reduced by double the movement of the guide roll 24 via the moveable guide roll 24.

In the simplest case, control device 100 can monitor whether the feed drive 31 is in operation or not. If feed drive 31 is not in operation, control device 100 supplies control drive 27 with energy so that control drive 27 moves guide roll 24 downwards at a predetermined speed. If feed drive 31 is in operation, control device 100 supplies control drive 27 so that guide roll 24 is moved upwards. If feed drive 31 is connected to a rotational speed sensor, then control device 100 can adapt the movement of guide roll 24 to the rotational speed of the feed drive 31 and thus to the feed speed of feeder rolls 30.

When the feed drive 31 is working again, the control drive 27 also moves the guide roll 24 upwards again in order to release fiber band 2-4 in a sufficient length. If for any reason feed drive 31 works more slowly than normal, then a corresponding compensation can be achieved via the control drive 27 when drawing off the bands 24 from the bobbins 7-9, e.g., in a startup phase.

Because the bands 2-4 are drawn off from the bobbins 7-9 at a constant speed, no differences in tension arise in the fiber bands. The fiber bands thus maintain virtually a constant tension overall.

The device 1 is shown here with three fiber bands 2-4, but more fiber bands are also possible, if a correspondingly greater number of bobbins is used.

Each fiber band 2-4 contains a number of fibers in the range of, e.g., 6,000 to 50,000 fibers. Even extremely fine fibers can be processed well with the device shown. Since, e.g., carbon fibers are endless, the referenced 6,000 to 50,000 fibers are present over the entire length, which can easily be several thousand meters.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be-limited to the particulars disclosed herein; rather, the present invention extends to all functionally equivalent structures, methods and uses, such as are within the scope of the appended claims.

The invention claimed is:

1. A device for feeding fiber bands to a knitting machine, the device comprising:

a creel including at least one bobbin having at least one fiber band;

at least one feeder roll structured and arranged to guide said least one fiber band;

at least one feed drive arranged to drive said at least one feeder roll;

a band storage including a motor driven control drive arranged to change a length of a variable length storage path for said at least one fiber band, wherein said band storage is arranged between said creel and said at least one feeder roll; and a control device arranged to actuate said motor driven control drive and said at least one feed drive in a manner coordinated with one another.

2. The device in accordance with claim 1, wherein said band storage has a guide roll supported on a carrier, such that said carrier is displaceable by said control drive.

3. The device in accordance with claim 1, further comprising a band swivel device, including a lever pivotable about an axis, an inflow guide and an outflow guide arranged for each bobbin, wherein each said inflow guide is arranged adjacent to a respective bobbin and each said outflow guide is positioned adjacent to a respective axis, such that said at least one fiber band is guided from said output guide to a fixed starting point.

4. The device in accordance with claim 1, further comprising a pressure device being arranged to extend over a length of each bobbin, wherein said at least one fiber band is drawn off from a respective bobbin through a nip between said pressure device and said respective bobbin.

5. A device for feeding fiber bands to a knitting machine, the device comprising:

a creel including at least one bobbin having at least one fiber band;

at least one feeder roll structured and arranged to guide said least one fiber band;

at least one feed drive arranged to drive said at least one feeder roll;

a band storage including a motor driven control drive arranged to change a length of a variable length storage path for said at least one fiber band, wherein said band storage is arranged between said creel and said at least one feeder roll;

a control device arranged to actuate said motor driven control drive and said at least one feed drive in a manner coordinated with one another; and a bobbin heating device for each bobbin.

6. A device for feeding fiber bands to a knitting machine, the device comprising:

a creel including at least one bobbin having at least one fiber band;

at least one feeder roll structured and arranged to guide said least one fiber band;

at least one feed drive arranged to drive said at least one feeder roll;

a band storage including a motor driven control drive arranged to change a length of a variable length storage path for said at least one fiber band, wherein said band storage is arranged between said creel and said at least one feeder roll;

a control device arranged to actuate said motor driven control drive and said at least one feed drive in a manner coordinated with one another; and a band heating arrangement arranged between said creel and said band storage.

7. The device in accordance with claim 6, wherein said band heating arrangement includes at least one heated guide rod arranged between said bobbin and said band swivel device.

8. The device in accordance with claim 6, wherein said band heating arrangement includes a band heating device at an intake of said band storage.

9. A device for feeding fiber bands to a knitting machine, the device comprising:

a creel including at least one bobbin having at least one fiber band;

at least one feeder roll structured and arranged to guide said least one fiber band;

at least one feed drive arranged to drive said at least one feeder roll;

a band storage including a motor driven control drive arranged to change a length of a variable length storage path for said at least one fiber band, wherein said band storage is arranged between said creel and said at least one feeder roll;

a control device arranged to actuate said motor driven control drive and said at least one feed drive in a manner coordinated with one another; and an output and a heating passage arranged in a movement direction of said at least one fiber band at least one of after said at least one feeder roll and close to said output.

10. The device in accordance with claim 9, wherein said heating passage has a length corresponding to a movement stroke of a band layer device arranged downstream of said output.

11. The device in accordance with claim 9, wherein a heating passage heating device is arranged at an output of said heating passage.

12. The device in accordance with claim 9, wherein a heating passage heating device is arranged at an intake of said heating passage.

13. The device in accordance with claim 1, further comprising an output and at least one spreader element arranged for each fiber band at said output.

14. A device for feeding fiber bands to a knitting machine, the device comprising:

a creel including at least one bobbin having at least one fiber band;

at least one feeder roll structured and arranged to guide said least one fiber band;

at least one feed drive arranged to drive said at least one feeder roll;

a band storage including a motor driven control drive arranged to change a length of a variable length storage path for said at least one fiber band, wherein said band storage is arranged between said creel and said at least one feeder roll;

a control device arranged to actuate said motor driven control drive and said at least one feed drive in a manner coordinated with one another; and an output and at least one spreader element arranged for each fiber band at said output, wherein said at least one spreader element has at least two guide edges running crosswise to said at least one fiber band and arranged opposite each other and separated in a fiber band run direction.

15. The device in accordance with claim 14, wherein said guide edges in a movement direction of said at least one fiber band have a spacing from one another that corresponds to 0.8 to 2 times a thickness of said at least one spreader element.

16. The device in accordance with claim 14, wherein a slotted hole arranged crosswise to said at least one fiber band is positioned between said guided edges.

17. The device in accordance with claim 16, wherein said at least one spreader element comprises a plurality of spreader elements arranged such that each respective slotted hole connects to one another in a crosswise direction to said at least one fiber band.

18. The device in accordance with claim 14, further comprising a heating passage, wherein said at least one spreader element is arranged behind said heating passage in the fiber band run direction.

* * * * *